US012742304B2

(12) United States Patent
Kamimae et al.

(10) Patent No.: US 12,742,304 B2
(45) Date of Patent: Sep. 22, 2026

(54) WORK MACHINE, AND METHOD AND SYSTEM FOR CONTROLLING WORK MACHINE

(71) Applicant: KOMATSU LTD., Tokyo (JP)

(72) Inventors: Takeshi Kamimae, Tokyo (JP); Hiroki Nagasaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 53 days.

(21) Appl. No.: 18/694,158

(22) PCT Filed: Nov. 9, 2022

(86) PCT No.: PCT/JP2022/041780
§ 371 (c)(1),
(2) Date: Mar. 21, 2024

(87) PCT Pub. No.: WO2023/112560
PCT Pub. Date: Jun. 22, 2023

(65) Prior Publication Data

US 2024/0392533 A1 Nov. 28, 2024

(30) Foreign Application Priority Data

Dec. 17, 2021 (JP) ..... 2021-205333

(51) Int. Cl.
*B62D 12/00* (2006.01)
*E02F 3/84* (2006.01)
*E02F 9/26* (2006.01)

(52) U.S. Cl.
CPC ..... *E02F 3/841* (2013.01); *E02F 9/265* (2013.01)

(58) Field of Classification Search
CPC ..... E02F 3/84; E02F 3/841; E02F 9/26; E02F 9/265; E02F 9/2203; E02F 3/845; B62D 12/00; B62D 9/04; B62K 5/10
(Continued)

(56) References Cited

U.S. PATENT DOCUMENTS 8,060,299 B2 11/2011 Gharsalli et al.
9,227,478 B2 * 1/2016 Horstman ..... B60G 21/007
(Continued)

FOREIGN PATENT DOCUMENTS

CN 101312874 A 11/2008
CN 108699803 A 10/2018
(Continued)

OTHER PUBLICATIONS

Y. Gao, F. Li and J. Chen, "Random Weighting Adaptive Estimation of Model Errors on Attitude Measurement for Rotary Steerable System," in IEEE Access, vol. 10, pp. 80794-80803, 2022, doi: 10.1109/ACCESS.2022.3195519. (Year: 2022).*
(Continued)

*Primary Examiner* — Cuong H Nguyen
(74) *Attorney, Agent, or Firm* — Spencer Fane LLP

(57) ABSTRACT

A work machine includes a vehicle body, a traveling wheel, a steering actuator, a leaning actuator, a leaning angle sensor, and a controller. The traveling wheel is supported by the vehicle body. The steering actuator changes a steering angle of the traveling wheel. The leaning actuator changes a leaning angle of the traveling wheel. The leaning angle sensor detects the leaning angle. The controller performs an automatic steering control that automatically steers the traveling wheel by controlling the steering actuator. The controller acquires the leaning angle. The controller limits travel of the vehicle body or limits the automatic steering control according to the leaning angle.

15 Claims, 8 Drawing Sheets

(58) Field of Classification Search
USPC ..... 280/6.154
See application file for complete search history.

(56) References Cited

U.S. PATENT DOCUMENTS

| | | | | |
|---|---|---|---|---|
| 11,124,941 | B2 * | 9/2021 | Benevelli | G05G 9/047 |
| 11,173,979 | B2 * | 11/2021 | Hara | B62K 5/027 |
| 2015/0165856 | A1 * | 6/2015 | Horstman | B60G 21/007 280/6.154 |
| 2019/0063035 | A1 | 2/2019 | Yamaguchi et al. | |
| 2020/0291609 | A1 * | 9/2020 | Tevis | E02F 3/7636 |
| 2020/0371515 | A1 * | 11/2020 | Westbrook | G06F 3/0346 |
| 2021/0316730 | A1 * | 10/2021 | Terada | B62J 45/40 |
| 2022/0298749 | A1 * | 9/2022 | Sonoda | B62D 6/04 |
| 2022/0325499 | A1 * | 10/2022 | Sonoda | E02F 3/841 |

FOREIGN PATENT DOCUMENTS

| | | | | |
|---|---|---|---|---|
| EP | 3296249 | A1 | | 3/2018 |
| JP | 58-164835 | A | | 9/1983 |
| JP | 11-115791 | A | | 4/1999 |
| JP | 2002067944 | A | * | 3/2002 |
| JP | 2017-171091 | A | | 9/2017 |
| JP | 2019049150 | A | | 3/2019 |
| JP | 2021-54269 | A | | 4/2021 |
| JP | 2021-54270 | A | | 4/2021 |

OTHER PUBLICATIONS

Chou, Hsiao-Yang, et al. "Developing and evaluating an autonomous agricultural all-terrain vehicle for field experimental rollover simulations." Computers and Electronics in Agriculture 194 (2022): 106735. (Year: 2022).*

Jiang, Yiyong, et al. "Research Review of Agricultural Machinery Power Chassis in Hilly and Mountainous Areas." Agriculture 15.11 (2025): 1158. (Year: 2025).*

Jiao, Zeyu, et al. "Research on Takagi-Sugeno Fuzzy-Model-Based Vehicle Stability Control for Autonomous Vehicles." Actuators. vol. 11. No. 6. MDPI, 2022. (Year: 2022).*

An English translation of Body tilt control device by Usui et al (JP2002067944A—Mar. 2, 2008) (Year: 2002).*

Brunner, Pascal, et al. "Analysis of experimental data on dynamics and behavior of e-scooter riders and applications to the impact of automated driving functions on urban road safety." 2020 IEEE Intelligent Vehicles Symposium (IV). IEEE, 2020. (Year: 2020).*

The Chinese Office Action for the corresponding Chinese patent application No. 202280062518.0 issued on May 26, 2026.

The International Search Report for the corresponding international application No. PCT/JP2022/041780, issued on Dec. 27, 2022.

* cited by examiner

WORK MACHINE, AND METHOD AND SYSTEM FOR CONTROLLING WORK MACHINE

CROSS-REFERENCE TO RELATED APPLICATIONS

This application is a U.S. National stage application of International Application No. PCT/JP2022/041780, filed on Nov. 9, 2022. This U.S. National stage application claims priority under 35 U.S.C. § 119(a) to Japanese Patent Application No. 2021-205333, filed in Japan on Dec. 17, 2021, the entire contents of which are hereby incorporated herein by reference.

BACKGROUND

Technical Field

The present invention relates to a work machine, and a method and a system for controlling a work machine.

Background Information

Conventionally, a technique for automatically controlling a steering angle of a traveling wheel in a work machine (hereinafter referred to as an "automatic steering control") is known. For example, in U.S. Pat. No. 8,060,299, a control system generates a target route of a work machine and controls a steering angle so that the work machine moves along the target route.

In Japanese Patent Application Publication No. 2021-54269, a controller of a work machine determines a target traveling direction of the work machine and controls a steering angle so that the work machine travels toward the target traveling direction. In Japanese Patent Application Publication No. 2021-54270, a controller of a work machine determines a target change rate of a traveling direction. The controller of the work machine controls a steering angle so that a change rate of the traveling direction per unit travel distance is kept at the target change rate.

SUMMARY

The work machines described above include a leaning mechanism that tilts a traveling wheel to the left and right. When the automatic steering control is performed with the traveling wheel tilted to the left and right, traveling stability may deteriorate depending on the magnitude of a leaning angle. An object of the present invention is to improve the traveling stability in a work machine including a traveling wheel that is able to lean.

A work machine according to a first aspect of the present invention includes a vehicle body, a traveling wheel, a steering actuator, a leaning actuator, a leaning angle sensor, and a controller. The traveling wheel is supported by the vehicle body. The steering actuator changes a steering angle of the traveling wheel. The leaning actuator changes a leaning angle of the traveling wheel. The leaning angle sensor detects the leaning angle. The controller performs an automatic steering control that automatically steers the traveling wheel by controlling the steering actuator. The controller acquires the leaning angle. The controller limits travel of the vehicle body or limits the automatic steering control according to the leaning angle.

A method according to a second aspect of the present invention is a method for controlling a work machine. The work machine includes a vehicle body, a traveling wheel, a steering actuator, and a leaning actuator. The traveling wheel is supported by the vehicle body. The steering actuator changes a steering angle of the traveling wheel. The leaning actuator changes a leaning angle of the traveling wheel.

The method according to the present aspect includes performing an automatic steering control that automatically steers the traveling wheel by controlling the steering actuator, acquiring the leaning angle, and limiting travel of the vehicle body or limiting the automatic steering control according to the leaning angle.

A system according to a third aspect of the present invention is a system for controlling a work machine. The work machine includes a vehicle body, a traveling wheel, a steering actuator, and a leaning actuator. The traveling wheel is supported by the vehicle body. The steering actuator changes a steering angle of the traveling wheel. The leaning actuator changes a leaning angle of the traveling wheel.

The system according to the present aspect includes a leaning angle sensor and a controller. The leaning angle sensor detects the leaning angle. The controller performs an automatic steering control that automatically steers the traveling wheel by controlling the steering actuator. The controller acquires the leaning angle. The controller limits travel of the vehicle body or limits the automatic steering control according to the leaning angle.

According to the present invention, the travel of the vehicle body is limited or the automatic steering control is limited according to the leaning angle. Therefore, when the leaning angle is large enough to deteriorate traveling stability, it is possible to limit the travel of the vehicle body or to limit the automatic steering control. This improves the traveling stability.

DETAILED DESCRIPTION OF EMBODIMENT(S)

Figure 1:
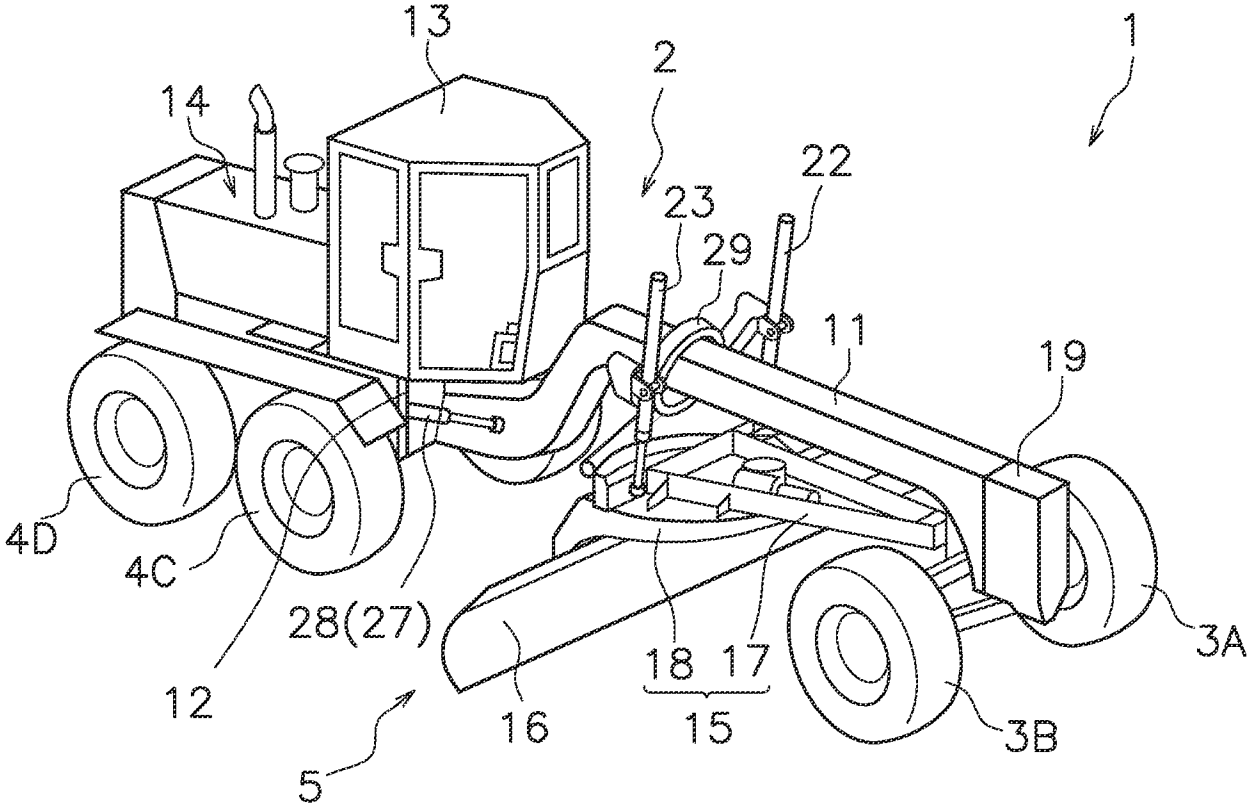
FIG. 1 is a perspective view of a work machine according to an embodiment.
Figure 2:
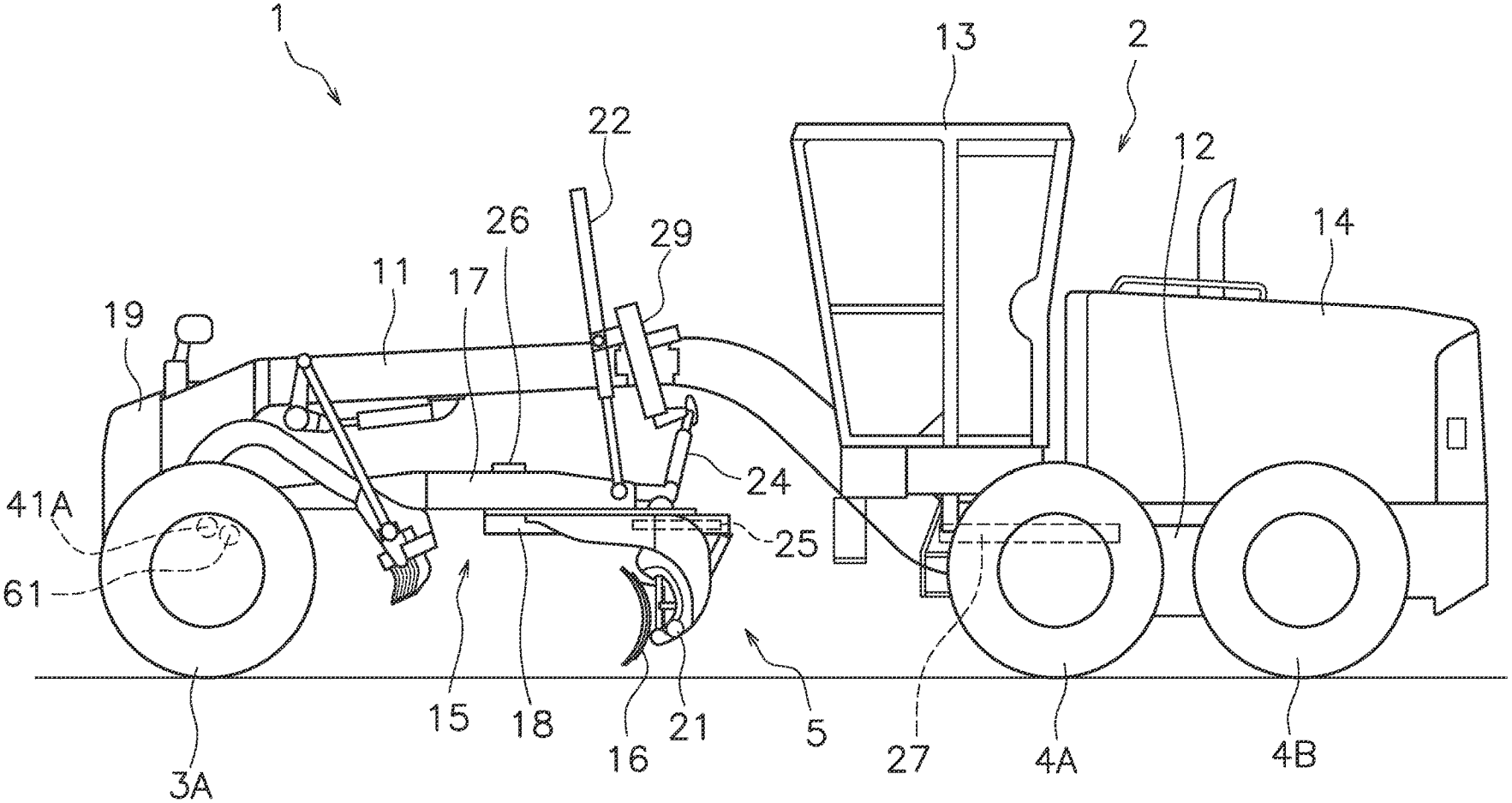
FIG. 2 is a side view of the work machine.

An embodiment of the present invention will be described below with reference to the drawings. FIG. 1 is a perspective view of a work machine 1 according to the embodiment. FIG. 2 is a side view of the work machine 1. As illustrated in FIG. 1, the work machine 1 includes a vehicle body 2, traveling wheels 3A, 3B, 4A to 4D, and a work implement 5. The vehicle body 2 includes a front frame 11, a rear frame 12, a cab 13, and a power compartment 14.

The rear frame 12 is connected to the front frame 11. The front frame 11 is coupled to the rear frame 12 so as to allow turning with respect to the rear frame 12. As described below, the front frame 11 is able to articulate to the left and right with respect to the rear frame 12.

In the following description, the front, rear, left, and right directions are defined as the front, rear, left, and right directions of the vehicle body 2 while an articulation angle of the front frame 11 with respect to the rear frame 12 is zero, that is, while the front frame 11 and the rear frame 12 are straight.

The cab 13 and the power compartment 14 are disposed on the rear frame 12. An unillustrated operator's seat is disposed in the cab 13. The power compartment 14 is disposed behind the cab 13. The front frame 11 extends forward from the rear frame 12.

The traveling wheels 3A, 3B, 4A to 4D are rotatably supported by the vehicle body 2. The traveling wheels 3A, 3B, 4A to 4D include front wheels 3A and 3B, and rear wheels 4A to 4D. The front wheels 3A and 3B are disposed apart from each other in the left-right direction. The front wheels 3A and 3B are attached to the front frame 11. The rear wheels 4A to 4D are attached to the rear frame 12.

The work implement 5 is movably connected to the vehicle body 2. The work implement 5 includes a supporting member 15 and a blade 16. The supporting member 15 is movably connected to the vehicle body 2. The supporting member 15 supports the blade 16. The supporting member 15 includes a drawbar 17 and a circle 18. The drawbar 17 is disposed below the front frame 11.

The drawbar 17 is connected to a front part 19 of the front frame 11. The drawbar 17 extends rearward from the front part 19 of the front frame 11. The drawbar 17 is swingably supported at least in the up-down direction and the left-right direction of the vehicle body 2 with respect to the front frame 11. For example, the front part 19 includes a ball joint. The drawbar 17 is rotatably connected to the front frame 11 via the ball joint.

The circle 18 is connected to a rear part of the drawbar 17. The circle 18 is supported so as to be rotatable with respect to the drawbar 17. The blade 16 is connected to the circle 18. The blade 16 is supported by the drawbar 17 via the circle 18. As illustrated in FIG. 2, the blade 16 is supported by the circle 18 so as to be rotatable about a tilt shaft 21. The tilt shaft 21 extends in the left-right direction.

Figure 3:
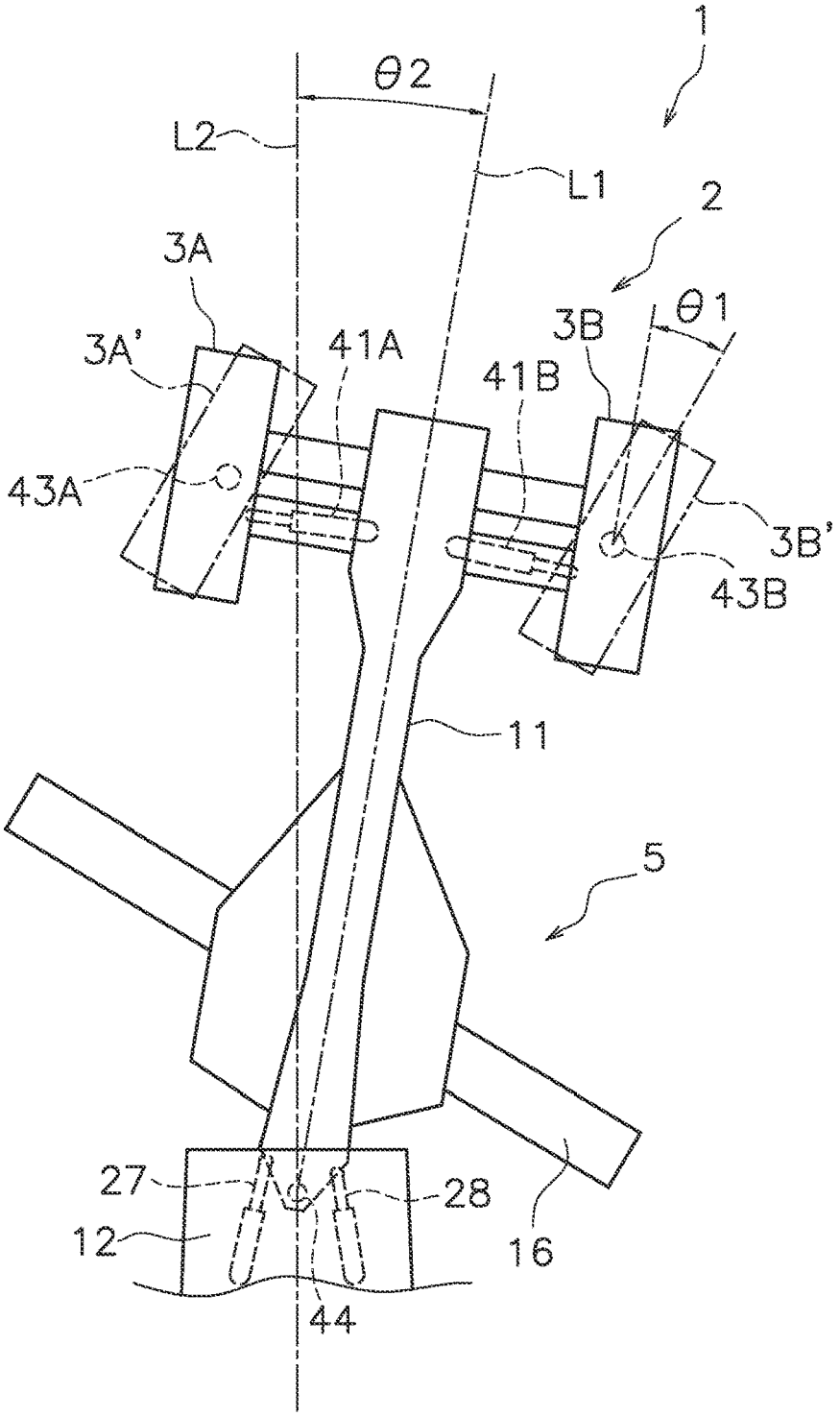
FIG. 3 is a top view of a front part of the work machine.

FIG. 3 is a top view of a front part of the work machine 1. As illustrated in FIG. 3, the work machine 1 includes a first steering shaft 43A and a second steering shaft 43B. The first steering shaft 43A and the second steering shaft 43B are provided to the front frame 11. The first steering shaft 43A and the second steering shaft 43B extend in the up-down direction. The front wheel 3A is supported so as to be rotatable about the first steering shaft 43A. The front wheel 3B is supported so as to be rotatable about the second steering shaft 43B.

The work machine 1 includes a plurality of steering actuators 41A and 41B for steering the front wheels 3A and 3B. The plurality of steering actuators 41A and 41B are used for steering the front wheels 3A and 3B. For example, the plurality of steering actuators 41A and 41B are hydraulic cylinders. The plurality of steering actuators 41A and 41B are respectively connected to the front wheels 3A and 3B. The plurality of steering actuators 41A and 41B extend and contract due to hydraulic pressure. In the following description, the extension and contraction of the plurality of steering actuators 41A and 41B, for example, the extension and contraction of the hydraulic cylinders are referred to as a "stroke motion."

The plurality of steering actuators 41A and 41B include a left steering cylinder 41A and a right steering cylinder 41B. The left steering cylinder 41A and the right steering cylinder 41B are disposed apart from each other in the left-right direction.

The left steering cylinder 41A is connected to the front frame 11 and the front wheel 3A. The right steering cylinder 41B is connected to the front frame 11 and the front wheel 3B. The front wheels 3A and 3B are steered by the stroke motions of the left steering cylinder 41A and the right steering cylinder 41B.

The work machine 1 includes an articulation shaft 44. The articulation shaft 44 is provided to the front frame 11 and the rear frame 12. The articulation shaft 44 extends in the up-down direction. The front frame 11 and the rear frame 12 are connected to each other so as to allow turning about the articulation shaft 44.

The work machine 1 includes a plurality of articulation actuators 27 and 28. The plurality of articulation actuators 27 and 28 are used for turning the front frame 11 with respect to the rear frame 12. For example, the plurality of articulation actuators 27 and 28 are hydraulic cylinders. The plurality of articulation actuators 27 and 28 are connected to the front frame 11 and the rear frame 12. The plurality of articulation actuators 27 and 28 extend and contract due to hydraulic pressure.

The plurality of articulation actuators 27 and 28 include a left articulation cylinder 27 and a right articulation cylinder 28. The left articulation cylinder 27 and the right articulation cylinder 28 are disposed apart from each other in the left-right direction.

The left articulation cylinder 27 is connected to the front frame 11 and the rear frame 12 on the left side of the vehicle body 2. The right articulation cylinder 28 is connected to the front frame 11 and the rear frame 12 on the right side of the vehicle body 2. The front frame 11 turns to the left or right with respect to the rear frame 12 due to the stroke motions of the left articulation cylinder 27 and the right articulation cylinder 28.

Figure 4:
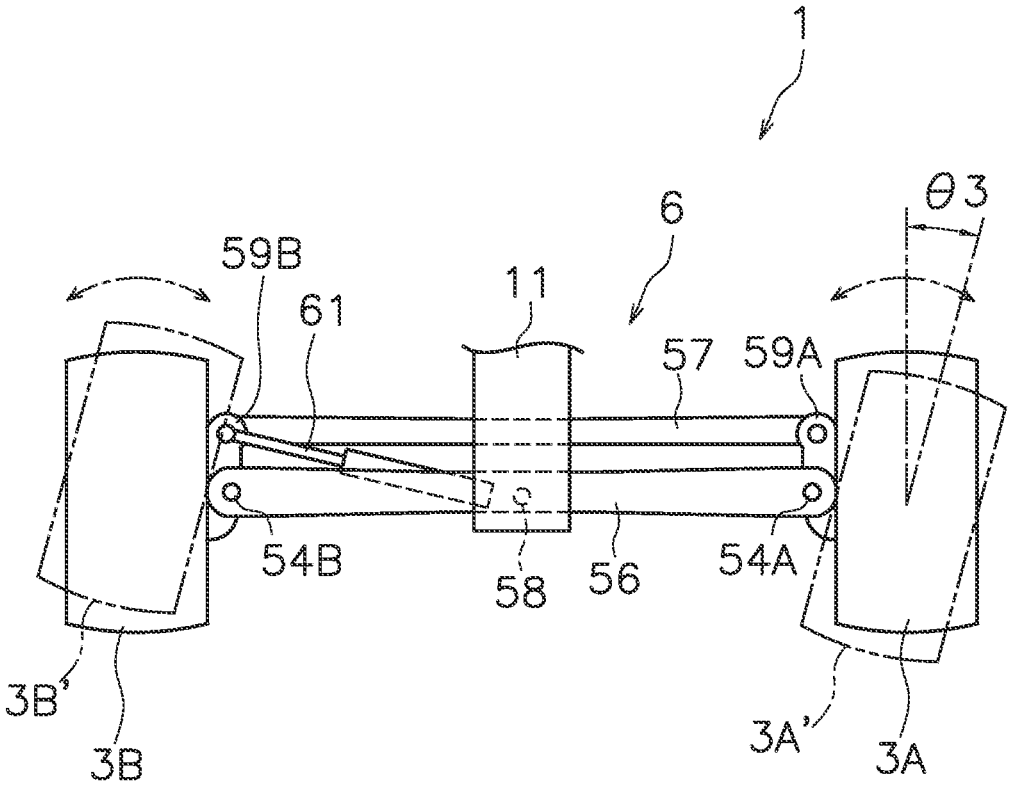
FIG. 4 is a front view of the front part of the work machine.

FIG. 4 is a front view of the front part of the work machine 1. As illustrated in FIG. 4, the work machine 1 includes a lean mechanism 6. The lean mechanism 6 tilts the front wheels 3A and 3B to the left and right. The lean mechanism 6 includes an axle beam 56, a leaning rod 57, and a leaning actuator 61. The axle beam 56 extends from the front frame 11 to the left and right. The axle beam 56 is supported by the front frame 11 so as to be rotatable about a pivot shaft 58.

The axle beam 56 is connected to the front wheel 3A by means of a wheel bracket 59A. The axle beam 56 supports the front wheel 3A so as to be rotatable about a leaning shaft 54A. The axle beam 56 is connected to the front wheel 3B by means of a wheel bracket 59B. The axle beam 56 supports the front wheel 3B so as to be rotatable about a leaning shaft 54B. The leaning shafts 54A and 54B extend in the front-rear direction.

The leaning rod 57 extends to the left and right through the front frame 11. The leaning rod 57 couples the front wheels 3A and 3B to each other. The leaning rod 57 is connected to the front wheel 3A by means of the wheel bracket 59A. The leaning rod 57 is connected to the front wheel 3B by means of the wheel bracket 59B.

The leaning actuator 61 is used for leaning the front wheels 3A and 3B. The leaning actuator 61 is, for example, a hydraulic cylinder. The leaning actuator 61 is connected to the front frame 11 and the front wheels 3A and 3B. The leaning actuator 61 extends and contracts due to hydraulic pressure. That is, the front wheels 3A and 3B respectively rotate about the leaning shafts 54A and 54B due to the extension and contraction of the leaning actuator 61. As a result, the front wheels 3A and 3B lean to the left or right.

As illustrated in FIG. 2, the work machine 1 includes a plurality of actuators 22 to 26 for changing an orientation of the work implement 5. The actuators 22 to 25 are, for example, hydraulic cylinders. The actuator 26 is a rotation actuator. In the present embodiment, the actuator 26 is a hydraulic motor. The actuator 26 may be an electric motor.

The plurality of actuators 22 to 25 are connected to the work implement 5. The plurality of actuators 22 to 25 extend and contract due to hydraulic pressure. The plurality of actuators 22 to 25 change the orientation of the work implement 5 with respect to the vehicle body 2 by extending and contracting.

Specifically, the plurality of actuators 22 to 25 include a left lift cylinder 22, a right lift cylinder 23, a drawbar shift cylinder 24, and a blade tilt cylinder 25.

The left lift cylinder 22 and the right lift cylinder 23 are disposed apart from each other in the left-right direction. The left lift cylinder 22 and the right lift cylinder 23 are connected to the drawbar 17. The left lift cylinder 22 and the right lift cylinder 23 are connected to the front frame 11 via a lifter bracket 29. The drawbar 17 swings up and down due to the stroke motions of the left lift cylinder 22 and the right lift cylinder 23. As a result, the blade 16 moves up and down.

The drawbar shift cylinder 24 is connected to the drawbar 17 and the front frame 11. The drawbar shift cylinder 24 is connected to the front frame 11 via the lifter bracket 29. The drawbar shift cylinder 24 extends diagonally downward from the front frame 11 toward the drawbar 17. The drawbar 17 swings left and right due to the stroke motions of the drawbar shift cylinder 24.

The blade tilt cylinder 25 is connected to the circle 18 and the blade 16. The blade 16 rotates about the tilt shaft 21 due to the stroke motions of the blade tilt cylinder 25.

The actuator 26 is connected to the drawbar 17 and the circle 18. The actuator 26 causes the circle 18 to rotate with respect to the drawbar 17. As a result, the blade 16 rotates about a rotation axis that extends in the up-down direction.

Figure 5:
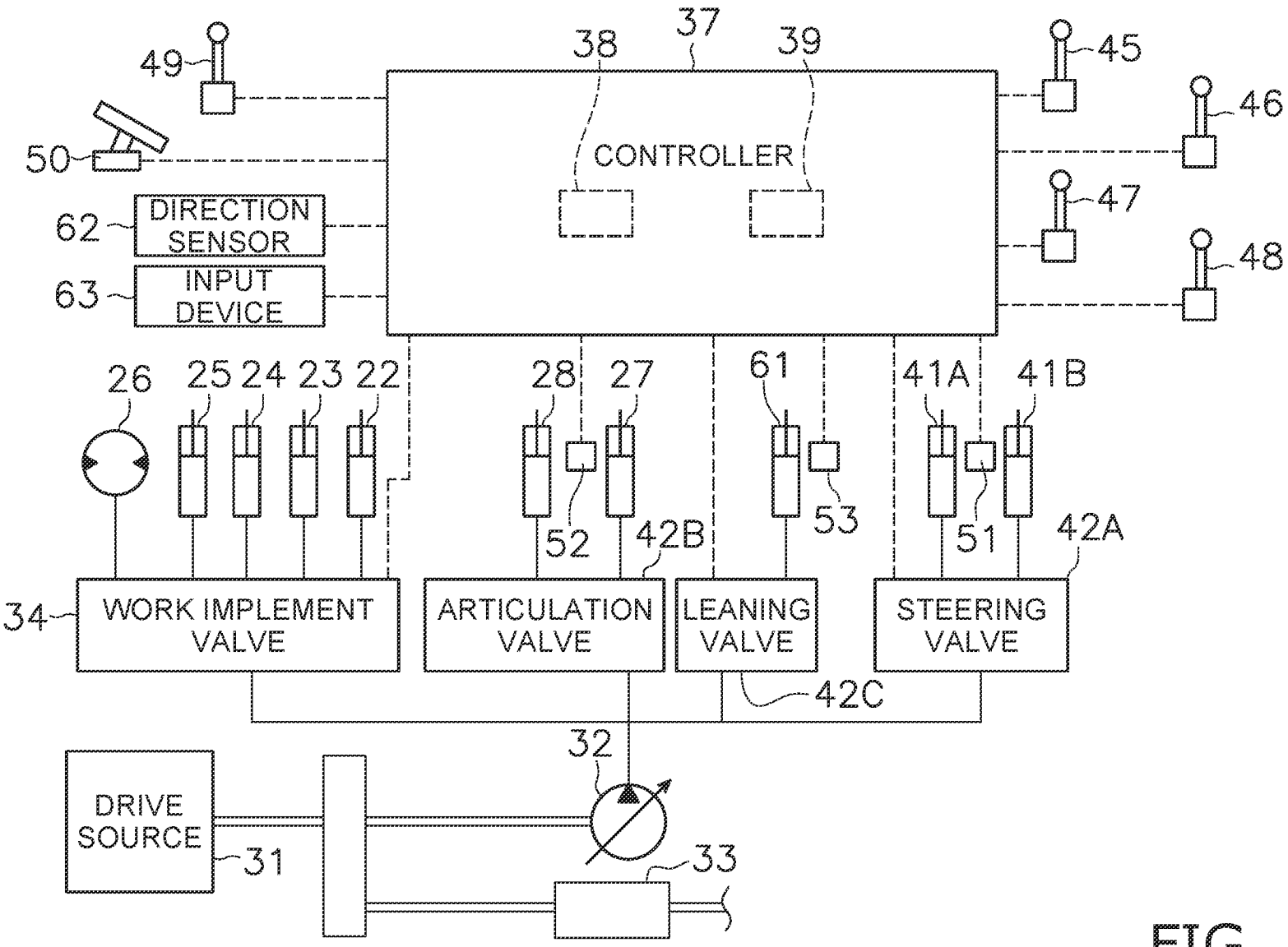
FIG. 5 is a schematic diagram illustrating a configuration of a control system of the work machine.

FIG. 5 is a schematic diagram illustrating a configuration of a control system of the work machine 1. As illustrated in FIG. 5, the work machine 1 includes a drive source 31, a hydraulic pump 32, and a power transmission device 33. The work machine 1 includes a steering valve 42A, an articulation valve 42B, a leaning valve 42C, and a work implement valve 34. The drive source 31 is, for example, an internal combustion engine. Alternatively, the drive source 31 may be an electric motor or a hybrid of an internal combustion engine and an electric motor.

The hydraulic pump 32 is driven by the drive source 31 thereby discharging hydraulic fluid. The hydraulic pump 32 supplies the hydraulic fluid to the steering valve 42A, the articulation valve 42B, the leaning valve 42C, and the work implement valve 34. Consequently, the plurality of steering actuators 41A and 41B, the plurality of articulation actuators 27 and 28, the leaning actuator 61, and the plurality of actuators 22 to 26 operate. Although one hydraulic pump 32 is illustrated in FIG. 5, a plurality of hydraulic pumps may be provided.

The steering valve 42A is connected to the hydraulic pump 32 and the plurality of steering actuators 41A and 41B through a hydraulic circuit. The steering valve 42A controls the flow rate of the hydraulic fluid supplied from the hydraulic pump 32 to the plurality of steering actuators 41A and 41B. The plurality of steering actuators 41A and 41B perform stroke motions due to the hydraulic fluid supplied from the hydraulic pump 32 to the steering valve 42A.

The articulation valve 42B is connected to the hydraulic pump 32 and the plurality of articulation actuators 27 and 28 through the hydraulic circuit. The articulation valve 42B controls the flow rate of the hydraulic fluid supplied from the hydraulic pump 32 to the plurality of articulation actuators 27 and 28. The plurality of articulation actuators 27 and 28 perform stroke motions due to the hydraulic fluid supplied from the hydraulic pump 32 to the articulation valve 42B.

The leaning valve 42C is connected to the hydraulic pump 32 and the leaning actuator 61 through the hydraulic circuit. The leaning valve 42C controls the flow rate of the hydraulic fluid supplied from the hydraulic pump 32 to the leaning actuator 61. The leaning actuator 61 performs stroke motions due to the hydraulic fluid supplied from the hydraulic pump 32 to the leaning valve 42C.

The work implement valve 34 is connected to the hydraulic pump 32 and the plurality of actuators 22 to 26 through the hydraulic circuit. The work implement valve 34 includes a plurality of valves respectively connected to the plurality of actuators 22 to 26. The work implement valve 34 controls the flow rate of the hydraulic fluid supplied from the hydraulic pump 32 to the plurality of actuators 22 to 26.

The power transmission device 33 transmits the driving force from the drive source 31 to the rear wheels 4A to 4D. The power transmission device 33 may include a torque converter and/or a plurality of speed change gears. Alternatively, the power transmission device 33 may be a transmission such as a hydraulic static transmission (HST) or a hydraulic mechanical transmission (HMT). The power transmission device 33 can be switched between a plurality of speed stages. The plurality of speed stages include, for example, first to fourth speeds for forward travel. The plurality of speed stages include, for example, first to fourth speeds for reverse travel. However, the number of speed stages is not limited to these and may be changed.

The work machine 1 includes a steering operating member 45, an articulating operating member 46, a leaning operating member 47, a work implement operating member 48, a shift operating member 49, and an accelerator operating member 50.

The steering operating member 45 is operable by an operator for steering the front wheels 3A and 3B. The steering operating member 45 is a lever such as a joystick. Alternatively, the steering operating member 45 may be a member other than a lever. For example, the steering operating member 45 may be a steering wheel. The steering operating member 45 outputs a steering operation signal indicative of an operation on the steering operating member 45 by the operator.

The articulating operating member 46 is operable by the operator for turning the front frame 11 with respect to the rear frame 12. The articulating operating member 46 is a lever such as a joystick. Alternatively, the articulating operating member 46 may be a member other than a lever. The articulating operating member 46 outputs an articulating operation signal indicative of an operation on the articulating operating member 46 by the operator.

The leaning operating member 47 is operable by the operator for leaning the front wheels 3A and 3B. The leaning operating member 47 is a lever such as a joystick. Alternatively, the leaning operating member 47 may be a member other than a lever. The leaning operating member 47 outputs a leaning operation signal indicative of an operation on the leaning operating member 47 by the operator.

The work implement operating member 48 is operable by the operator for changing an orientation of the work implement 5. The work implement operating member 48 includes, for example, a plurality of work implement levers. Alternatively, the work implement operating member 48 may be another member such as a switch or a touch screen. The work implement operating member 48 outputs a signal indicative of an operation on the work implement operating member 48 by the operator.

The shift operating member 49 is operable by the operator for switching between forward travel and reverse travel of the work machine 1. The shift operating member 49 includes, for example, a shift lever. Alternatively, the shift operating member 49 may be another member such as a switch or a touch screen. The shift operating member 49 outputs a signal indicative of an operation on the shift operating member 49 by the operator.

The accelerator operating member 50 is operable by the operator for causing the work machine 1 to travel. The accelerator operating member 50 includes, for example, an accelerator pedal. Alternatively, the accelerator operating member 50 may be another member such as a switch or a touch screen. The accelerator operating member 50 outputs a signal indicative of an operation on the accelerator operating member 50 by the operator.

The work machine 1 includes a steering angle sensor 51, an articulation angle sensor 52, and a leaning angle sensor 53. The steering angle sensor 51 is used for detecting a steering angle θ1 of the front wheels 3A and 3B. The steering angle sensor 51 outputs a steering angle signal indicative of the steering angle θ1. The steering angle signal is, for example, the stroke amounts of the plurality of steering actuators 41A and 41B. The steering angle sensor 51 may directly detect the steering angle θ1.

As illustrated in FIG. 3, the steering angle θ1 is the angle at which the front wheels 3A and 3B turn with respect to the front frame 11 about the first steering shaft 43A and the second steering shaft 43B respectively. Specifically, the steering angle θ1 is the turning angle of the front wheels 3A and 3B with respect to a first center line L1 of the front frame 11. The first center line L1 extends in the front-rear direction of the front frame 11.

The steering angle θ1 changes from a neutral position to the left or right due to the stroke motions of the plurality of steering actuators 41A and 41B. The steering angle θ1 at the neutral position is zero degrees. The front wheels 3A and 3B are disposed parallel to the first center line L1 of the front frame 11 at the neutral position. In FIGS. 3, 3A' and 3B' indicate the front wheels while turned by the steering angle θ1 from the neutral position to the right.

The articulation angle sensor 52 is used for detecting an articulation angle of the front frame 11 with respect to the rear frame 12. The articulation angle sensor 52 outputs an articulation angle signal indicative of an articulation angle θ2. The articulation angle signal is, for example, the stroke amounts of the left articulation cylinder 27 and the right articulation cylinder 28. The articulation angle sensor 52 may directly detect the articulation angle θ2.

As illustrated in FIG. 3, the articulation angle θ2 is the angle at which the front frame 11 turns with respect to the rear frame 12 about the articulation shaft 44. Specifically, the articulation angle θ2 is the angle between the first center line L1 of the front frame 11 and a second center line L2 of the rear frame 12.

The second center line L2 extends in the front-rear direction of the rear frame 12. The second center line L2 passes through the articulation shaft 44 as seen in a top view of the work machine 1. The articulation angle θ2 changes from a neutral position to the left or right. The articulation angle θ2 at the neutral position is zero degrees. When the articulation angle θ2 is zero, the direction of the second center line L2 matches the direction of the first center line L1. FIG. 3 illustrates a state in which the front frame 11 is turned by the articulation angle θ2 about the articulation shaft 44.

The leaning angle sensor 53 is used for detecting a leaning angle θ3 of the front wheels 3A and 3B. The leaning angle sensor 53 outputs a leaning angle signal indicative of the leaning angle θ3. The leaning angle signal is, for example, the stroke amount of the leaning actuator 61. The leaning angle sensor 53 may directly detect the leaning angle θ3.

As illustrated in FIG. 4, the leaning angle θ3 is the tilt angle in the left-right direction of the front wheels 3A and 3B as seen from the front of the vehicle body 2. For example, the leaning angle θ3 is the tilt angle at which the front wheels 3A and 3B are respectively tilted about the leaning shafts 54A and 54B as seen from the front of the vehicle body 2. In the following description, the state in which the front wheels 3A and 3B are perpendicular to a horizontal surface (3A and 3B depicted with solid lines) is referred to as a neutral position of the front wheels 3A and 3B. The leaning angle θ3 is zero degrees while the front wheels 3A and 3B are in the neutral position. In FIGS. 4, 3A' and 3B' indicate the front wheels tilted by the leaning angle θ3 from the neutral position to the left.

As illustrated in FIG. 5, the work machine 1 includes a controller 37. The controller 37 includes a storage device 38 and a processor 39. The processor 39 is, for example, a CPU and executes programs for controlling the work machine 1. The storage device 38 includes a memory such as a RAM and a ROM, and an auxiliary storage device such as an SSD or an HDD. The storage device 38 stores programs and data for controlling the work machine 1.

The controller 37 controls the power transmission device 33 in response to an operation on the shift operating member 49. As a result, the traveling direction of the work machine 1 is switched between forward travel and reverse travel. Further, the speed stages of the power transmission device 33 are switched. Alternatively, the shift operating member 49 may be mechanically connected to the power transmission device 33. The action of the shift operating member 49 may be mechanically transmitted to the power transmission device 33, whereby the gears for forward travel and reverse travel or the speed change gears of the power transmission device 33 may be switched.

The controller 37 controls the drive source 31 and the power transmission device 33 in response to an operation on the accelerator operating member 50. As a result, the work machine 1 travels. Further, the controller 37 controls the hydraulic pump 32 and the work implement valve 34 in response to an operation on the work implement operating member 48. As a result, the work implement 5 operates.

The controller 37 acquires the operating amount of the steering operating member 45 from the steering operation signal from the steering operating member 45. The controller 37 controls the steering valve 42A according to the steering operation signal, thereby causing the plurality of steering actuators 41A and 41B to extend and contract. As a result, the controller 37 changes the steering angle θ1 of the front wheels 3A and 3B. The controller 37 acquires the steering angle signal from the steering angle sensor 51. The controller 37 calculates the steering angle θ1 of the front wheels 3A and 3B based on the steering angle signal.

The controller 37 acquires the operating amount of the articulating operating member 46 from the articulating operation signal from the articulating operating member 46. The controller 37 controls the articulation valve 42B. For example, the controller 37 controls the articulation valve 42B according to the articulating operation signal, thereby causing the left articulation cylinder 27 and the right articulation cylinder 28 to extend and contract. As a result, the controller 37 changes the articulation angle. The controller 37 acquires the articulation angle signal from the articulation angle sensor 52. The controller 37 calculates the articulation angle θ2 based on the articulation angle signal.

The controller 37 acquires the operating amount of the leaning operating member 47 from the leaning operation signal from the leaning operating member 47. The controller 37 controls the leaning valve 42C. For example, the controller 37 controls the leaning valve 42C according to the leaning operation signal, thereby causing the leaning actuator 61 to extend and contract. As a result, the controller 37 changes the leaning angle θ3 according to the operation on the leaning operating member 47 by the operator. The controller 37 acquires the leaning angle signal from the leaning angle sensor 53. The controller 37 calculates the leaning angle θ3 based on the leaning angle signal.

The work machine 1 includes a direction sensor 62. The direction sensor 62 detects a traveling direction of the vehicle body 2. The direction sensor 62 outputs a direction signal indicative of the traveling direction of the vehicle body 2. The controller 37 acquires the traveling direction of the vehicle body 2 from the direction signal from the direction sensor 62. The traveling direction of the vehicle body 2 is indicated, for example, by the yaw angle of the vehicle body 2.

The direction sensor 62 is, for example, an inertial measurement unit (IMU). The controller 37 calculates the traveling direction of the vehicle body 2 based on the acceleration and the angular velocity of the vehicle body 2. Alternatively, the direction sensor 62 may be a position sensor of a global navigation satellite system (GNSS) such as a global positioning system (GPS). The controller 37 may acquire the traveling direction of the vehicle body 2 from a change in position of the work machine 1 detected by the direction sensor 62.

The work machine 1 includes an input device 63. The input device 63 is operable by the operator for setting ON/OFF of an automatic steering control. In the automatic steering control, the controller 37 automatically steers the front wheels 3A and 3B by controlling the steering actuators 41A and 41B. The input device 63 is, for example, a switch. Alternatively, the input device 63 may be another device operable by the operator such as a touch screen. When the automatic steering control is set to ON with the input device 63, the controller 37 performs the automatic steering control.

Figure 6:
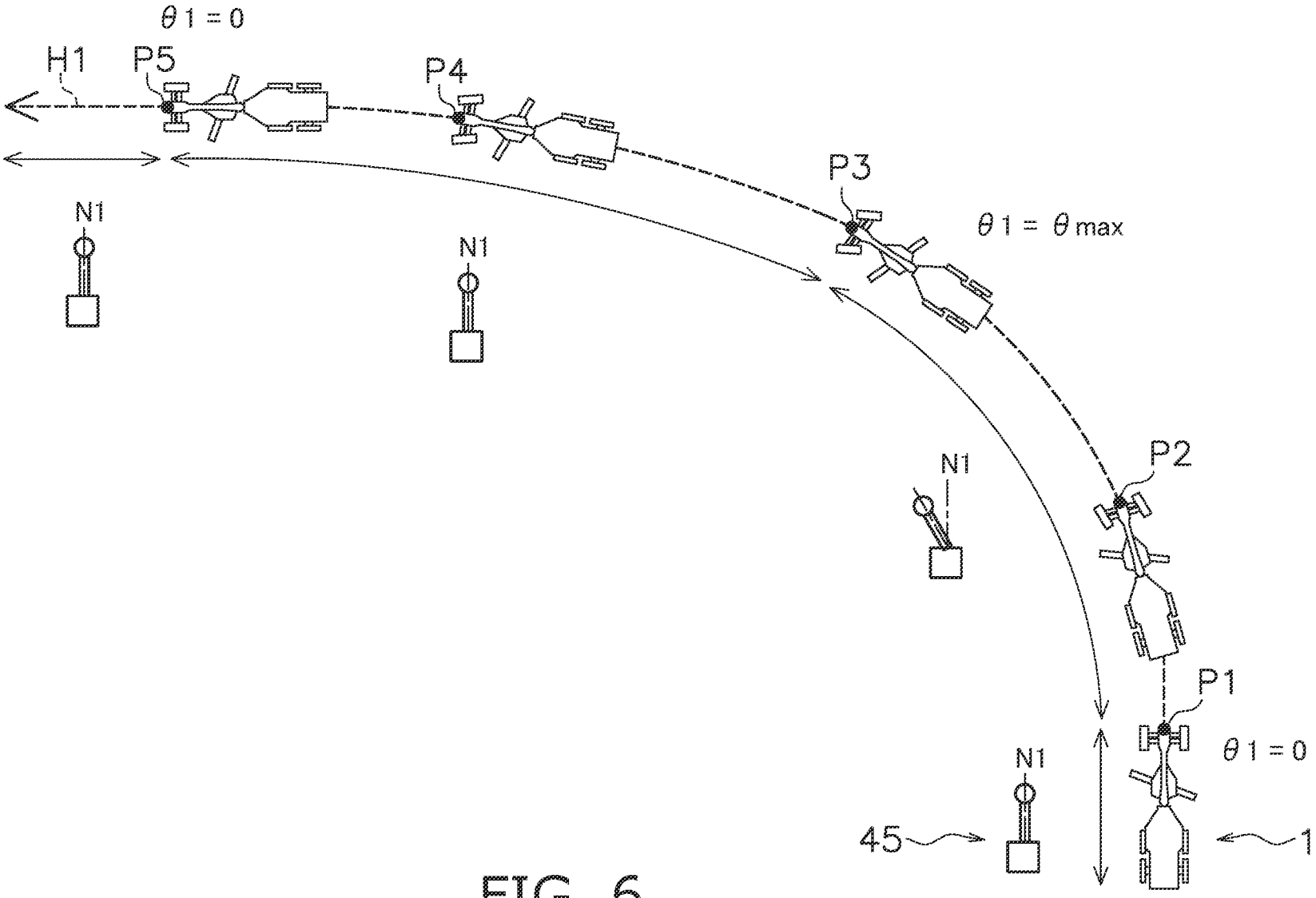
FIG. 6 is a view illustrating a direction keeping control that is an example of an automatic steering control.

FIG. 6 is a view illustrating of a direction keeping control that is an example of the automatic steering control. In the direction keeping control, the controller 37 determines a target traveling direction of the work machine 1 and controls the steering angle so that the work machine 1 travels toward the target traveling direction. For example, as illustrated in FIG. 6, while the work machine 1 is at a position P1, the steering operating member 45 is positioned at a neutral position N1 and the steering angle θ1 is zero.

When the operator manually operates the steering operating member 45 to the left while causing the work machine 1 to travel forward, the work machine 1, while turning to the left, moves from the position P1 through a position P2 to a position P3 where the steering angle θ1 is changed to θmax to the left. When the operator returns the steering operating member 45 to the neutral position N1 or operates the steering operating member 45 in the opposite direction at a position P4, the steering angle θ1 returns to zero at a position P5 and the work machine 1 starts traveling straight.

For example, the controller 37 stores, as a start condition of the direction keeping control, the fact that the steering angle θ1 has returned to zero after the steering operating member 45 being operated from the neutral position N1. The start condition of the direction keeping control is not limited to the fact that the steering angle θ1 has returned to zero. The start condition of the direction keeping control may be, for example, the fact that a command to start the direction keeping control has been given, such as the fact that a predetermined operation button has been pressed by the operator. The controller 37 acquires the traveling direction of the work machine 1 when the start condition is satisfied from the direction signal from the direction sensor 62. Then, the controller 37 sets the traveling direction of the work machine 1 when the start condition is satisfied as the target traveling direction. That is, as illustrated in FIG. 6, the controller 37 determines a traveling direction H1 of the work machine 1 at the position P5 as the target traveling direction. The controller 37 controls the steering angle θ1 so that the traveling direction of the work machine 1 is kept in the target traveling direction H1.

In the automatic steering control, the traveling speed of the work machine 1 may be adjusted manually with the accelerator operating member 50 or automatically with the controller 37. The start condition of the direction keeping control may be the fact that the steering operating member 45 has returned to the neutral position N1 at the position P4.

When the aforementioned automatic steering control is performed with the front frame 11 being largely articulated from the neutral position with respect to the rear frame 12, the traveling stability may deteriorate. Further, when the aforementioned automatic steering control is performed with the front wheels 3A and 3B largely leaning from the neutral position, the traveling stability may deteriorate. Therefore, in the control system of the work machine 1 according to the present embodiment, the controller 37 performs a limit control that limits the automatic steering control according to the articulation angle θ2 and the leaning angle θ3.

Figure 7:
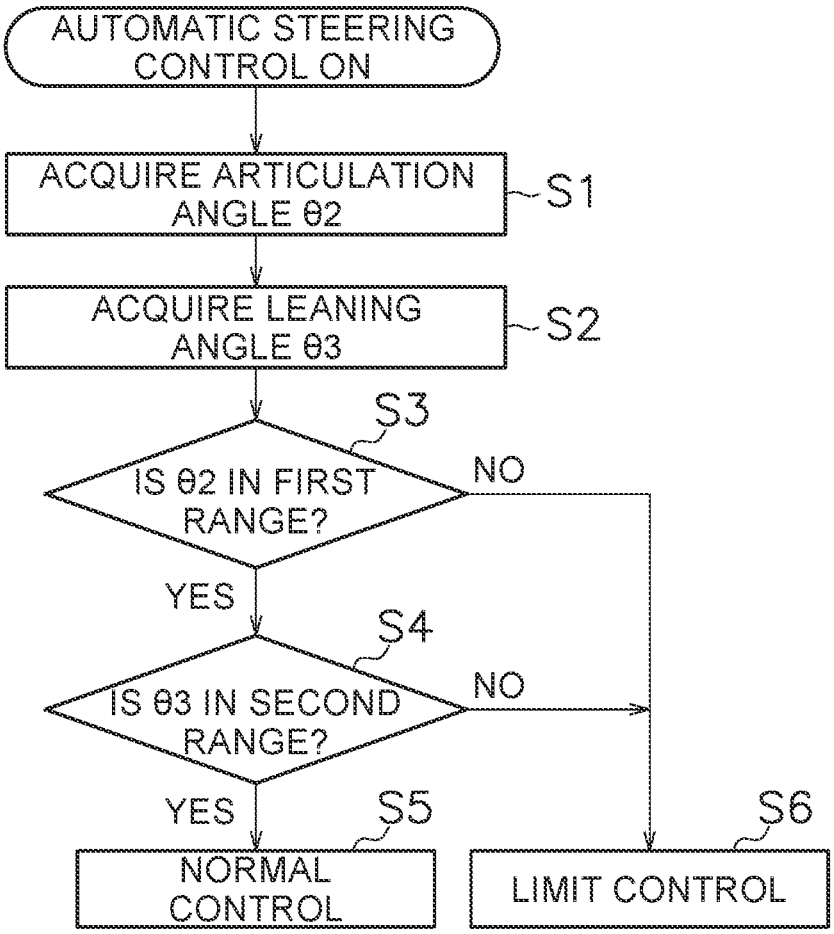
FIG. 7 is a flowchart illustrating processes of a limit control performed by a controller.

FIG. 7 is a flowchart illustrating processes of the limit control performed by the controller 37. As illustrated in FIG. 7, in step S1, the controller 37 acquires the articulation angle θ2. The controller 37 acquires the articulation angle θ2 based on the articulation angle signal from the articulation angle sensor 52.

In step S2, the controller 37 acquires the leaning angle θ3. The controller 37 acquires the leaning angle θ3 based on the leaning angle signal from the leaning angle sensor 53.

In step S3, the controller 37 determines whether the articulation angle θ2 is in a first range. The first range represents a range of the articulation angle θ2 in which the preferable traveling stability can be ensured. The first range includes the neutral position and is a range between a left upper limit value and a right upper limit value of the articulation angle θ2. When the articulation angle θ2 is in the first range, the process proceeds to step S4.

In step S4, the controller 37 determines whether the leaning angle θ3 is in a second range. The second range represents a range of the leaning angle θ3 in which the preferable traveling stability can be ensured. The second range includes the neutral position and is a range between a left upper limit value and a right upper limit value of the leaning angle θ3. When the leaning angle θ3 is in the second range, the process proceeds to step S5. In step S5, the controller 37 performs the aforementioned automatic steering control as a normal control.

On the other hand, in step S3, in a case where the articulation angle θ2 is outside of the first range, the process proceeds to step S6. For example, when the articulation angle θ2 is larger than the left upper limit value, the process proceeds to step S6. Alternatively, when the articulation angle θ2 is larger than the right upper limit value, the process proceeds to step S6.

In step S6, the controller 37 performs the limit control. In the limit control, the controller 37 disables the automatic steering control regardless of the operation on the input device 63. Therefore, in a case where the articulation angle θ2 is outside of the first range, the controller 37 will not start the automatic steering control, even if the automatic steering control is set to ON with the input device 63 and the aforementioned start condition is satisfied. During the limit control, the operator is notified that the automatic steering control is disabled. As a notification means, any known means such as illuminating a warning lamp or emitting a warning sound can be employed.

Similarly, in a case where the leaning angle θ3 is outside of the second range in step S4, the process proceeds to step S6 and the controller 37 performs the limit control. For example, when the leaning angle θ3 is larger than the left upper limit value, the controller 37 performs the limit control. When the leaning angle θ3 is larger than the right upper limit value, the controller 37 performs the limit control.

In the work machine 1 according to the present embodiment described above, when the articulation angle θ2 is outside of the first range, the automatic steering control is limited by the limit control. Therefore, when the articulation angle θ2 is large enough to deteriorate the traveling stability, the automatic steering control is limited. This improves the traveling stability.

When the leaning angle θ3 is outside of the second range, the automatic steering control is limited by the limitation control. Therefore, when the leaning angle θ3 is large enough to deteriorate the traveling stability, the automatic steering control is limited. This improves the traveling stability.

Although one embodiment of the present invention has been described above, the present invention is not limited to the above embodiment and various changes can be made without departing from the gist of the invention.

The configuration of the work machine 1 is not limited to that of the above configuration and may be changed. For example, the configuration of the work implement 5 may be changed. A portion of the control system of the work machine 1 may be disposed outside of the work machine 1. For example, the various operating members and the input device 63 of the work machine 1 may be disposed outside of the work machine 1.

The controller 37 may be configured by a plurality of controllers. The aforementioned processes may be distributed and performed among the plurality of controllers. A portion of the plurality of controllers may be disposed outside of the work machine 1.

The automatic steering control is not limited to the aforementioned direction keeping control and may be another control. For example, the automatic steering control may be an automatic route following control. In the automatic route following control, the controller 37 controls the steering angle θ1 so that the work machine 1 moves along the target route.

Figure 8:
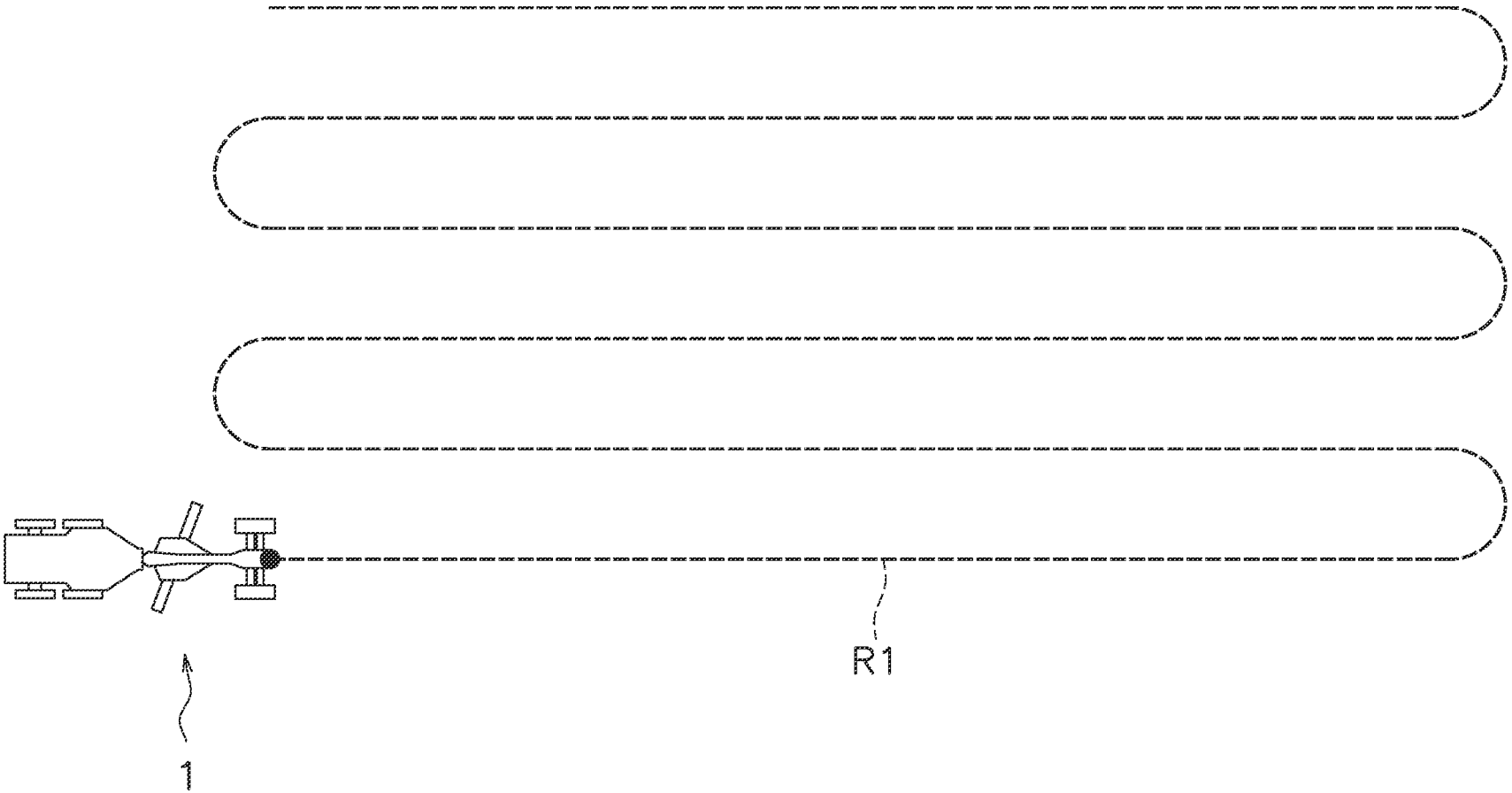
FIG. 8 is a view illustrating an automatic route following control that is another example of the automatic steering control.

FIG. 8 is a view illustrating the automatic route following control that is an example of the automatic steering control. As illustrated in FIG. 8, the controller 37 acquires a target route R1. The controller 37 may acquire the target route R1 from an external computer. The controller 37 starts the automatic route following control (automatic steering control) using the fact that a command to start the control has been given, such as the fact that a predetermined operation button has been pressed by the operator, as a start condition. Alternatively, the controller 37 may generate the target route R1 in response to an operation on the input device 63. In the automatic route following control, the controller 37 controls the steering angle θ1 so that the work machine 1 moves along the target route R1. The normal control and the limit control under the automatic steering control are the same as described with reference to FIG. 7, so the description thereof will be omitted.

In the above embodiment, the controller 37 disables the automatic steering control in the limit control. However, the limit control is not limited to that of the above embodiment and may be changed.

For example, the controller 37 may limit the travel of the vehicle body 2 in the limit control. The controller 37 may limit an upper limit of the speed stage of the power transmission device 33 in the limit control. The controller 37 may set the upper limit of the speed stage for forward travel of the power transmission device 33 to the third speed in the normal control of the automatic steering control. The controller 37 may set the upper limit of the speed stage for forward travel of the power transmission device 33 to the second speed in the limit control. The controller 37 may set the upper limit of the speed stage for reverse travel of the power transmission device 33 to the third speed in the normal control of the automatic steering control. The controller 37 may set the upper limit of the speed stage for reverse travel of the power transmission device 33 to the second speed in the limit control.

The controller 37 may limit an upper limit of the vehicle speed of the work machine 1 in the limit control. For example, the controller 37 may set the upper limit of the vehicle speed of the work machine 1 as a first upper limit vehicle speed in the normal control of the automatic steering control. The controller 37 may set the upper limit of the vehicle speed of the work machine 1 as a second upper limit vehicle speed that is smaller than the first upper limit vehicle speed in the limit control.

In the above embodiment, the controller 37 performs the limit control even when the articulation angle θ2 is outside of the first range. However, the limit control according to the articulation angle θ2 may be omitted.

According to the present invention, the traveling stability is improved in the work machine including the traveling wheel that is able to lean.

The invention claimed is:

1. A work machine comprising:

a vehicle body;

a traveling wheel supported by the vehicle body;

a steering actuator configured to change a steering angle of the traveling wheel;

a leaning actuator configured to change an actual leaning angle of the traveling wheel, the actual leaning angle being an angle in a left-right direction of the traveling wheel when viewed from a front of the vehicle body;

a leaning angle sensor configured to detect the actual leaning angle; and a controller configured to perform an automatic steering control that automatically steers the traveling wheel by controlling the steering actuator, acquire the actual leaning angle, and limit travel of the vehicle body or limit the automatic steering control according to the actual leaning angle.

2. The work machine according to claim 1, wherein the controller is configured to limit the travel of the vehicle body or limit the automatic steering control when the actual leaning angle is outside of a predetermined range.

3. The work machine according to claim 1, further comprising:

a power transmission device configured to be switched between a plurality of speed stages, the controller being configured to limit an upper limit of the plurality of speed stages according to the actual leaning angle.

4. The work machine according to claim 1, wherein the controller is configured to limit an upper limit of a vehicle speed of the work machine according to the actual leaning angle.

5. The work machine according to claim 1, wherein the controller is configured to disable the automatic steering control according to the actual leaning angle.

6. The work machine according to claim 5, further comprising:

an input device configured to be operated to set ON/OFF of the automatic steering control, the controller being configured to disable the automatic steering control according to the actual leaning angle regardless of an operation on the input device.

7. A method for controlling a work machine that includes a vehicle body, a traveling wheel supported by the vehicle body, a steering actuator configured to change a steering angle of the traveling wheel, and a leaning actuator configured to change an actual leaning angle of the traveling wheel, the method comprising:

performing an automatic steering control that automatically steers the traveling wheel by controlling the steering actuator;

acquiring the actual leaning angle, the actual leaning angle being an angle in a left-right direction of the traveling wheel when viewed from a front of the vehicle body; and limiting travel of the vehicle body or limiting the automatic steering control according to the actual leaning angle during movement of the work machine.

8. The method according to claim 7, further comprising:

limiting the travel of the vehicle body or limiting the automatic steering control when the actual leaning angle is outside of a predetermined range.

9. The method according to claim 7, wherein the work machine further includes a power transmission device configured to be switched between a plurality of speed stages, and the method further comprises limiting an upper limit of the plurality of speed stages according to the actual leaning angle.

10. The method according to claim 7, further comprising:

limiting an upper limit of a vehicle speed of the work machine according to the actual leaning angle.

11. The method according to claim 7, further comprising:

disabling the automatic steering control according to the actual leaning angle.

12. The method according to claim 11, further comprising:

setting ON/OFF of the automatic steering control according to an operation on an input device; and disabling the automatic steering control according to the actual leaning angle regardless of the operation on the input device.

13. A system for controlling a work machine that includes a vehicle body, a traveling wheel supported by the vehicle body, a steering actuator configured to change a steering angle of the traveling wheel, and a leaning actuator configured to change an actual leaning angle of the traveling wheel, the system comprising:

a leaning angle sensor configured to detect the actual leaning angle; and a controller configured to perform an automatic steering control that automatically steers the traveling wheel by controlling the steering actuator, acquire the actual leaning angle, the actual leaning angle being an angle in a left-right direction of the traveling wheel when viewed from a front of the vehicle body, and limit travel of the vehicle body or limit the automatic steering control according to the actual leaning angle.

14. The system according to claim 13, wherein the controller is configured to limit the travel of the vehicle body or limit the automatic steering control when the actual leaning angle is outside of a predetermined range.

15. The system according to claim 13, wherein the work machine further includes a power transmission device configured to be switched between a plurality of speed stages, and the controller is further configured to limit an upper limit of the plurality of speed stages according to the actual leaning angle.

* * * * *